United States Patent [19]

Swanson, Jr.

[11] 4,076,466

[45] * Feb. 28, 1978

[54] FLUID PUMP FOR USE IN EXPLOSIVE BORE HOLES

[75] Inventor: Floyd R. Swanson, Jr., Cedar Falls, Iowa

[73] Assignee: Swanson Engineering, Inc., Cedar Falls, Iowa

[ * ] Notice: The portion of the term of this patent subsequent to Nov. 2, 1993, has been disclaimed.

[21] Appl. No.: 675,151

[22] Filed: Apr. 8, 1976

Related U.S. Application Data

[63] Continuation of Ser. No. 361,496, May 18, 1973, Pat. No. 3,989,418.

[51] Int. Cl.[2] ..... F04B 9/08; F04B 17/00

[52] U.S. Cl. ..... 417/390; 417/406; 415/501

[58] Field of Search ..... 418/48; 417/390, 405, 417/406; 166/68, 68.5, 75; 175/103, 107; 415/501

[56] References Cited

U.S. PATENT DOCUMENTS

| | | | |
|---|---|---|---|
| 1,739,000 | 12/1929 | Jordao | 417/409 |
| 2,149,600 | 3/1939 | Guinard | 417/390 |
| 2,311,963 | 2/1943 | Pyle | 415/501 |
| 2,648,286 | 8/1953 | Bergh | 415/501 |
| 2,706,450 | 4/1955 | Bodine | 415/501 |
| 2,883,833 | 4/1959 | Miles | 417/424 |
| 3,025,800 | 3/1962 | Wolfe et al. | 415/501 |
| 3,274,940 | 9/1966 | Cottrell | 417/43 |
| 3,347,169 | 10/1967 | Cronin et al. | 418/48 |
| 3,437,045 | 4/1969 | Tremain | 415/501 |

*Primary Examiner*—Carlton R. Croyle
*Assistant Examiner*—Thomas I. Ross
*Attorney, Agent, or Firm*—Zarley, McKee, Thomte, Voorhees & Sease

[57] ABSTRACT

A fluid pump for use in explosive bore holes comprising an elongated outer housing having upper and lower ends and adapted to permit water to enter the interior thereof. A hydraulic motor is secured to and is positioned in the lower end of the outer housing. A pump housing extends upwardly from the hydraulic motor within the outer housing. A drive shaft rotatably extends upwardly from the hydraulic motor within the pump housing and has a rotor means connected thereto for rotation therewith. The rotor rotatably extends through a pump stator means which is positioned in the pump housing. A pair of hydraulic hoses are in communication with a source of hydraulic fluid under pressure and extend downwardly into the outer housing between the outer housing and pump housing. The hoses are fluidly connected to the hydraulic motor. A discharge line is fluidly connected to the upper end of the pump housing so that water in the bore hole will be pumped upwardly through the discharge line upon actuation of the hydraulic motor. Circuitry is provided to automatically deactivate the hydraulic motor when the water has been completely removed from the bore hole. Means is also provided to prevent rocks or the like from falling in the bore hole when the pump is positioned therein. Means is also provided for removing the fluid pump from the bore hole.

7 Claims, 8 Drawing Figures

FLUID PUMP FOR USE IN EXPLOSIVE BORE HOLES

This is a continuation application of co-pending application Ser. No. 361,496, filed May 18, 1973, now U.S. Pat. No. 3,989,418.

BACKGROUND OF THE INVENTION

This invention relates to a fluid pump and more particularly to a fluid pump which may be used in explosive bore holes. Mining and quarrying ordinarily involve blasting operations. The blasting is achieved by drilling a plurality of bore holes in the rock or the like. Dynamite of ANFO is ordinarily placed in the bore holes to achieve the necessary blasting. ANFO is comprised of ammonia nitrate mixed with fuel oil and is less expensive than the dynamite. The problem connected with the use of ANFO in the bore holes is the bore holes are frequently filled with water which dissolves the ANFO and prevents detonation.

A further problem in removing the water from the bore holes is that rocks or the like tend to fall downwardly into the bore hole which interferes with the removal of any pump means which has been previously positioned in the bore hole. A still further problem encountered with the removal of the water from the bore holes is that the fluid pump can be seriously damaged if the pump continues to run after all of the water has been removed from the bore hole.

Therefore, it is a principal object of the invention to provide a fluid pump.

A further object of the invention is to provide a fluid pump which may be used to pump the water from a bore hole.

A further object of the invention is to provide a fluid pump which is extremely compact.

A further object of the invention is to provide a fluid pump for use in bore holes which is efficient.

A further object of the invention is to provide a fluid pump for use in explosive bore holes which includes a hydraulic motor thereby decreasing the possibility of prematurely detonating the blasting agent.

A further object of the invention is to provide a fluid pump for use in bore holes including means for automatically deactivating the fluid pump when the water has been removed from the bore hole.

A further object of the invention is to provide means for preventing rocks or the like from falling downwardly into the bore hole as the water is being removed therefrom.

A further object of the invention is to provide means for removing the fluid pump from the bore hole after the water has been removed therefrom.

A further object of the invention is to provide a fluid pump for use in explosive bore holes which is durable in use.

These and other objects will be apparent to those skilled in the art.

BRIEF DESCRIPTION OF THE DRAWINGS

This invention consists in the construction, arrangements and combination of the various parts of the device, whereby the objects contemplated are attained as hereinafter more fully set forth, specifically pointed out in the claims, and illustrated in the accompanying drawings, in which:

DESCRIPTION OF THE PREFERRED EMBODIMENT

Figure 1:
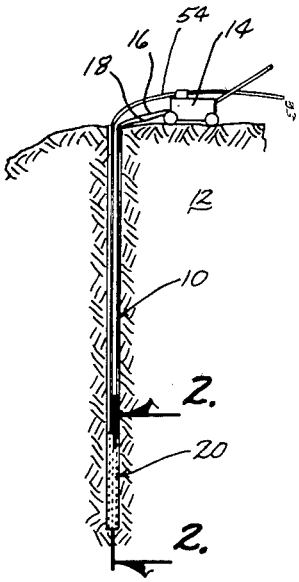
FIG. 1 is a side view depicting the fluid pump of this invention lowered into a bore hole.

In the drawings, the numeral 10 refers to a bore hole which has been drilled in the rock or the like which is referred to by the reference numeral 12. The numeral 14 generally referes to a source of hydraulic fluid under pressure such as a hydraulic pump or the like having a pair of hydraulic hoses 16 and 18 extending therefrom downwardly into the bore hole 10. The circuitry of the hydraulic pump will be described in more detail hereinafter.

The fluid pump of this invention is referred to generally by the reference numeral 20 and comprises an outer housing 22 having a plurality of water inlet openings 24 formed therein to permit water to enter the interior thereof. The numeral 26 refers to a conventional hydraulic motor which is retained to the pump housing 36 which is welded to plug 52. Outer housing 22 and bottom 30 are welded together and assembled over the hydraulic motor 26 and pump element and welded to plug 52. Spacer 32 is provided between motor 26 and 30.

Figure 2:
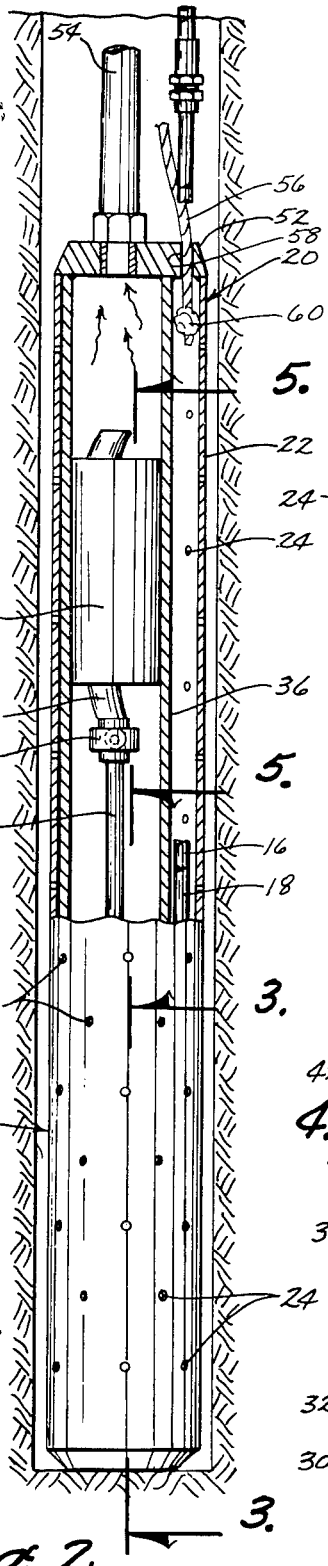
FIG. 2 is an enlarged sectional view seen on lines 2—2 of FIG. 1.
Figure 5:
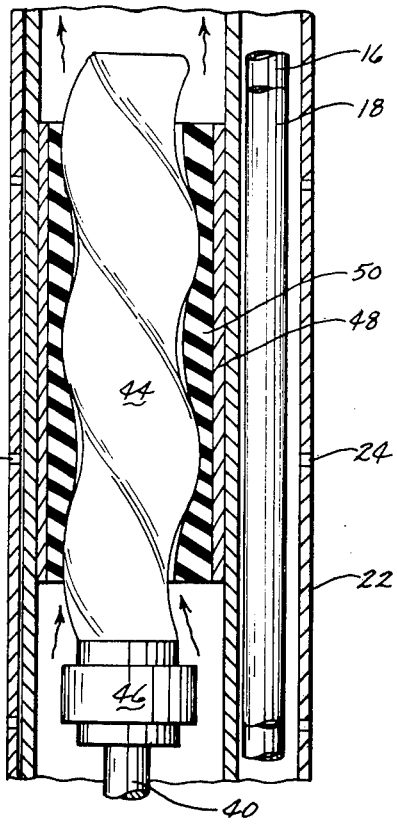
FIG. 5 is an enlarged sectional view seen on lines 5—5 of FIG. 2.
Figure 4:
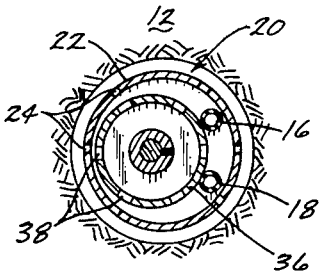
FIG. 4 is a sectional view seen on lines 4—4 of FIG. 3.
Figure 3:
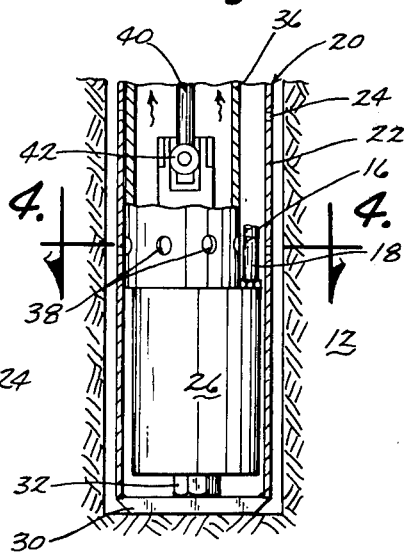
FIG. 3 is a sectional view seen on lines 3—3 of FIG. 2.

Pump housing 36 extends upwardly from the hydraulic motor 26 within housing 22 and has a plurality of openings 38 formed in its lower end adapted to permit water to enter the interior thereof. As seen in FIG. 3, the openings 38 are located above the motor 26. The location of the openings above the motor avoids the necessity of having any fluid conduits on the outside of the motor which would be required if the openings were located below the top of the motor. As a result, the overall diameter of the outer housing 22 is decreased since no room is required for water conduits between the outside of motor 26 and the inside surface of housing 22. Further, the location of openings 38 above the motor 26 helps to protect the motor from debris, mud and the like. Hydraulic motor 26 is provided with a rotatable drive shaft 40 extending upwardly therefrom and including a universal joint 42 imposed therein. The upper end of shaft 40 is connected to a screw-like rotor 44 by means of collar 46. Rotor 44 rotatably extends through a pump stator 48 positioned in pump housing 36. As seen in FIG. 5, stator 48 includes a cylindrical resilient liner 50 which yieldably engages the exterior surface of the screw-like rotor 44. A discharge conduit or line 54 is secured to plug 52 for communication with the upper end of housing 36 as also seen in FIG. 2. Discharge line 54 extends upwardly through the bore hole 10 and laterally therefrom for discharging the water or fluid from the bore hole as illustrated in FIG. 1. As seen in the drawings, the hydraulic hoses 16 and 18 extend downwardly through the bore hole 10 and through a pair of spaced apart openings formed in plug 52. The hoses 16 and 18 bypass the pump housing 36 and pass between the exterior surface of the pump housing 36 and the interior surface of the outer housing 22. The hoses 16 and 18 are fluidly connected to the hydraulic motor 26 as illustrated in FIG. 3. The numeral 56 refers to a polyethylene cable which extends downwardly through the bore hole 10. The lower end of cable 56 is extended through an opening 58 formed in plug 52 as seen in FIG. 2. A knot 60 is formed on the lower end of the cable 56 so that upward movement of the cable 56 in the bore hole 10 will cause the fluid pump 20 to be raised likewise.

Figure 6:
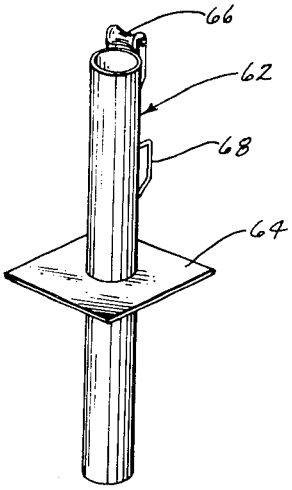
FIG. 6 is a perspective view illustrating the pipe shield which is mounted in the top of the bore hole.
Figure 7:
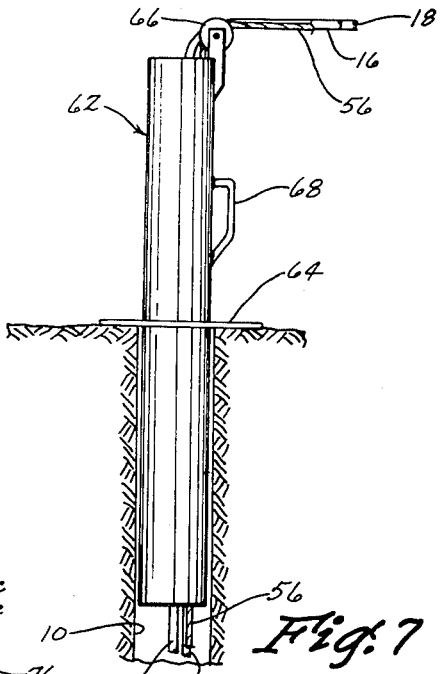
FIG. 7 is a side view of the pipe shield of FIG. 6.

The numeral 62 refers to a pipe shield having an outer diameter substantially that of the bore hole 10. A flat plate or shield 64 is secured to the pipe shield 62 as seen in FIGS. 6 and 7 for limiting the downward movement of the pipe shield 62 with respect to the bore hole 10 as seen in FIG. 7. The plate 64 engages the ground adjacent the upper end of the bore hole to prevent debris or the like from being dropped into the upper end of the bore hole 10. A pulley 66 is rotatably mounted at the upper end of the pipe shield 62 and is adapted to have the cable 56 extend thereover. Handle 68 is provided on the pipe shield 62 for positioning the same relative to the hole.

Figure 8:
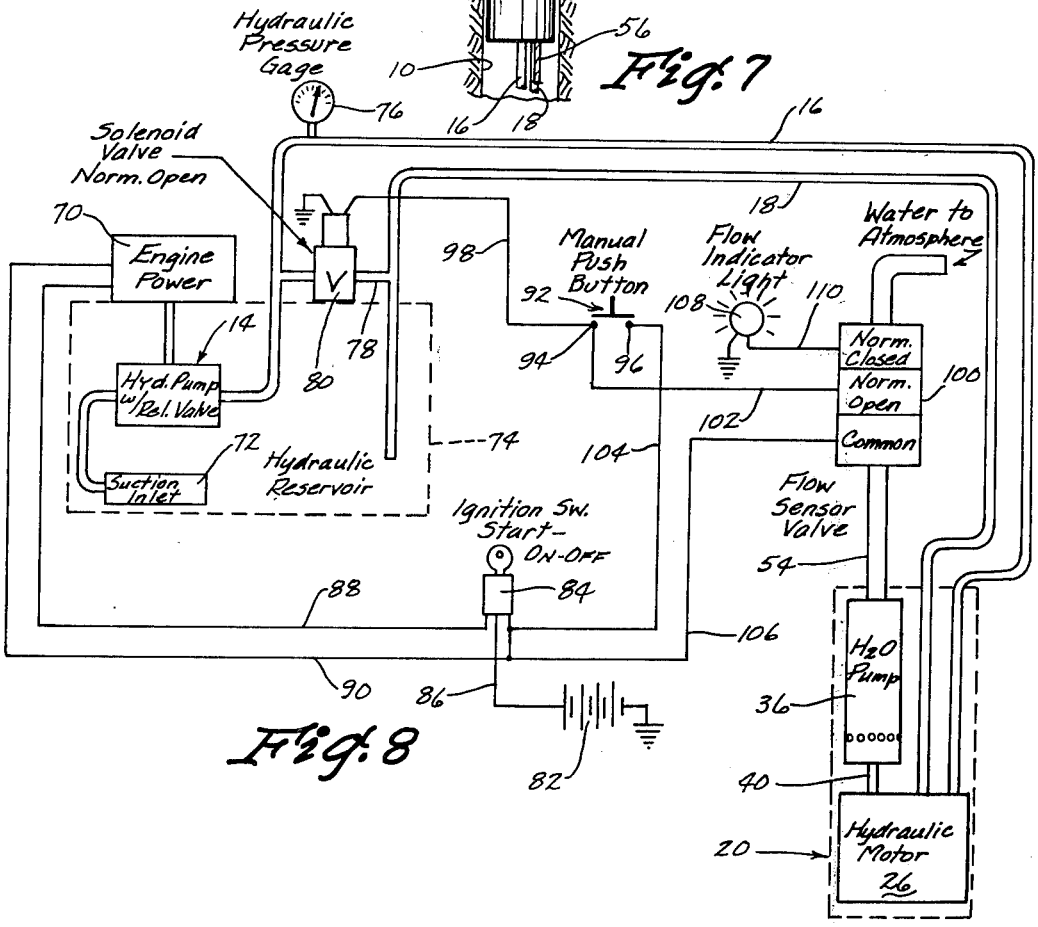
FIG. 8 is a schematic of the circuitry of the invention.

In FIG. 8, it can be seen that engine 70 is operatively connected to the hydraulic pump 14 which has a suction inlet 72 in communication with the hydraulic reservoir 74. Hose or line 16 has a hydraulic pressure gauge 76 imposed therein as illustrated in FIG. 8. Line 76 fluidly connects hoses 16 and 18 and has a normally open solenoid valve 80 imposed therein.

The numeral 82 refers to a battery connected to an ignition switch 84 by wire 86. Wires 88 and 90 connect the engine 80 with the switch 84 as depicted in FIG. 8. The numeral 92 refers to a manual push botton switch having a pair of contacts 94 and 96. contact 94 is connected to the valve 80 by wire 98 and is connected to a flow sensor switch 100 by wire 102. Contact 96 is connected to the switch 84 by wire 104. Wire 106 also connects the switch 100 with the switch 84 as seen in FIG. 8. Switch 100 is electrically connected to a flow indicator light 108 by wire 110.

The normal method of operation is as follows. The bore hole would have previously been drilled and would ordinarily have a diameter of 3 to 5 inches. The pipe shield 62 is placed in the upper end of the bore hole as seen in FIG. 7. The fluid pump 20 is then lowered into the bore hole 10 through the pipe shield 62 by means of the hydraulic hoses, discharge line and polyethylene cable 56. The fluid pump is lowered into the bore hole until it is positioned on the bottom thereof as seen in FIG. 2. The water in the bore hole will enter the interior of the outer housing 24 and the interior of the pump housing 36. It is contemplated that the smallest model of the pump will have an outer housing diameter of approximately 2.25 inches which will allow the dewatering of the small bore holes. The key of the switch 84 is then turned on and the flow indicator light 108 will light to show battery current. The engine 70 is then started which activates the hydraulic pump 14 so that the fluid will be pumped through the normally open solenoid valve 80 into the hydraulic reservoir 74. The switch 92 is normally open and the closing of the same causes current to close the solenoid valve 80 so that the hydraulic fluid will be supplied to the hydraulic motor 26 through the hose or line 16. Actuation of the hydraulic motor 26 causes the shaft 40 and rotor 44 to be rotated. The screw-like rotor 44 rotates within the fixed resilient stator 48 to form progressing cavities in the stator 48 which moves the fluid in the pump housing upwardly as indicated by the arrows in the drawings. The water is pumped upwardly from the stator 48 upwardly through the discharge line 54. The water flows through the flow sensor switch 100 to activate the same which allows current to the solenoid valve but halts the flow of current to the indicator light 108 to deactivate the same. The push button switch 92 is then released. The hydraulic motor 26 continues to operate until the bore hole has been completely dewatered. When the water flow through the switch 100 is stopped, the flow sensor switch 100 becomes activated and stops the flow of current to the solenoid valve 80 which then opens so that the flow of fluid to the hydraulic motor 26 will be halted to deactivate the same. The flow indicator light 108 is also illuminated when the flow of water is halted through the flow sensor switch 100 to indicate that the bore hole has been dewatered. The switch 84 can then be moved to its "off" position to deactivate the engine 70 if desired. However, it is preferable to leave the engine running until all the holes are dewatered.

It should be noted that a normally closed solenoid valve could be substituted for the valve 80 with certain electrical circuit changes being incorporated in the schematic of FIG. 8. It should also be noted that a two-way-two position solenoid valve could be substituted for the valve 80 if so desired.

The pipe shield 62 prevents debris or the like from falling downwardly into the bore hole which could cause problems in removing the fluid pump from the bore hole. If difficulty is encountered in removing the fluid pump from the bore hole, it is simply necessary to connect the cable 56 to a tractor or the like to exert upwardly force thereon which pulls the fluid pump from the bore hole due to the connection of the lower end of the cable 56 with the plug 52. The pulley 66 is adapted to receive the cable 56, or the hydraulic hoses to the pump to protect these elongated members as required.

After the fluid pump has been removed from the bore hole, the pipe shield 62 may also be removed from the upper end thereof. The blasting agent may then be placed in the bore hole without fear that the blasting agent will be diluted with ground water. The small compact fluid pump permits it to be used in bore holes and permits the dewatering of bore holes which have heretofore not been practically possible. Thus it can be seen that the fluid pump of this invention accomplishes at least all of its stated objectives.

I claim:

1. A fluid pump for use in explosive bore holes comprising, an elongated cylindrical first housing having upper and lower end plates, said first housing having means provided thereon to permit water to enter the interior thereof, a hydraulic motor having upper and lower ends secured in said housing adjacent the lower end thereof, a pump housing extending upwardly from said hydraulic motor within said first housing, said pump housing having a fluid intake opening means located above said hydraulic motor, a hydraulic hose means in communication with a source of hydraulic fluid under pressure and extending through the upper end plate of said first housing and thence downwardly into said first housing between said first housing and said pump housing, said hose means being fluidly connected to the upper end of said hydraulic motor, a drive shaft extending upwardly from said hydraulic motor within said pump housing, a pump stator means positioned in said pump housing, a pump rotor means connected to said drive shaft for rotation therewith and extending through said pump stator means, and a discharge line fluidly connected to said pump housing and extending through the upper end plate so that water in the bore hole will be pumped upwardly through said discharge line upon actuation of said hydraulic motor;

said hydraulic motor having a cross-sectional area which substantially conforms to the inner cross-sectional area of said first housing, said pump housing having a cross-sectional area less than the cross-sectional area of said hydraulic motor and the internal cross-sectional area of said first housing and being eccentrically positioned with respect to the longitudinal axis of said first housing to provide an access space for said hydraulic hose means so that said hose means can extend through said first housing adjacent to said pump housing.

2. The fluid pump of claim 1 wherein said hose means comprises first and second hydraulic hoses.

3. The fluid pump of claim 1 wherein said stator means comprises a first rigid hollow cylindrical member positioned in said pump housing and a second resilient hollow cylindrical stator liner positioned in said first cylindrical member, said rotor comprising a screw-like member extending through and engaging said second cylindrical member.

4. The fluid pump of claim 1 wherein said discharge line is secured to the upper end of said pump housing.

5. The fluid pump of claim 1 wherein said first housing has a plurality of perforations formed therein to permit the fluid to enter the interior thereof, said intake opening means in said pump housing comprises a plurality of openings formed therein adjacent its lower end above said hydraulic motor to permit the fluid to enter the interior thereof.

6. The fluid pump of claim 1 wherein said source of hydraulic fluid under pressure comprises a motor means connected to a hydraulic pump fluidly connected to said hose means and control means for automatically deactivating said hydraulic motor when the water in the bore hole has been removed therefrom.

7. The fluid pump of claim 6 wherein said control means comprises a flow sensor switch means in communication with said discharge line which deactivates said hydraulic motor.

* * * * *